US007866122B2

(12) United States Patent
Pipes et al.

(10) Patent No.: US 7,866,122 B2
(45) Date of Patent: Jan. 11, 2011

(54) EQUIPMENT FOR MANUFACTURING CIGARETTE PACKAGES

(75) Inventors: Jerry Wayne Pipes, Clemmons, NC (US); Wesley Steven Jones, Winston-Salem, NC (US); Randy Lee McKnight, Lewisville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 12/813,103

(22) Filed: Jun. 10, 2010

(65) Prior Publication Data

US 2010/0248926 A1 Sep. 30, 2010

Related U.S. Application Data

(62) Division of application No. 12/101,529, filed on Apr. 11, 2008, now Pat. No. 7,762,046.

(51) Int. Cl.
*B65B 51/05* (2006.01)
*B65B 19/22* (2006.01)
*B31B 1/62* (2006.01)

(52) U.S. Cl. ..... 53/64; 53/203; 53/383.1; 118/684; 493/10; 493/126; 493/151

(58) Field of Classification Search ..... 53/51, 53/64, 140, 141, 148, 203, 210, 220, 221, 53/228, 383.1; 118/683, 684; 493/8, 10, 493/122, 126, 128, 130, 131, 150, 151, 328, 493/331; *B65B 51/02, 19/22; B31B 1/62*
See application file for complete search history.

(56) References Cited

U.S. PATENT DOCUMENTS 1,458,977 A 6/1923 De Escobales
1,957,777 A 5/1934 Heath
1,962,338 A 6/1934 Church
1,971,868 A 8/1934 Molins
2,141,752 A 12/1938 Hoarle (Continued)

FOREIGN PATENT DOCUMENTS

DE 296 04 863 7/1997

(Continued)

OTHER PUBLICATIONS

Machine translation of JP 6-226887, retrieved from JPO website http://www4.ipdl.inpit.go.jp/Tokujitu/tjsogodbenk.ipdl, Sep. 22, 2010, 9 pages.*

(Continued)

*Primary Examiner*—Stephen F Gerrity
(74) *Attorney, Agent, or Firm*—Brinks Hofer Gilson & Lione

(57) ABSTRACT

Systems and methods are provided for making a hard pack cigarette package composed of a transparent material that includes an inner frame that is also composed of a transparent material. The package is assembled using a hot-melt adhesive material to bind the package together as well as to bind the inner frame insert and a foil wrapped assemblage of smoking articles to the package. The hot-melt adhesive material is applied by an electronically controlled hot-melt adhesive applicator working in conjunction with a uniform contrast roller.

4 Claims, 6 Drawing Sheets

U.S. PATENT DOCUMENTS

| | | | | | |
|---|---|---|---|---|---|
| 2,183,330 | A | | 12/1939 | Drew | |
| 2,197,388 | A | | 4/1940 | Towers | |
| 2,301,575 | A | | 11/1942 | Often | |
| 2,333,270 | A | | 11/1943 | Opler | |
| 3,245,525 | A | | 4/1966 | Shoemaker | |
| 3,527,014 | A | | 9/1970 | Wahle et al. | |
| 3,695,422 | A | | 10/1972 | Tripodi | |
| 3,874,581 | A | | 4/1975 | Fox et al. | |
| 3,944,066 | A | | 3/1976 | Niepmann | |
| 3,986,440 | A | * | 10/1976 | Macdonald et al. | 493/150 |
| 3,999,655 | A | | 12/1976 | Molins et al. | |
| RE29,847 | E | | 11/1978 | Davies | |
| 4,389,971 | A | * | 6/1983 | Schmidt | 118/684 |
| 4,500,937 | A | * | 2/1985 | Matt | 118/684 |
| 4,717,017 | A | | 1/1988 | Sprinkel, Jr. et al. | |
| 4,836,378 | A | | 6/1989 | Lephardt | |
| 4,852,734 | A | | 8/1989 | Allen et al. | |
| 4,923,059 | A | | 5/1990 | Evers et al. | |
| 5,024,709 | A | | 6/1991 | Faulkner, III et al. | |
| 5,139,140 | A | | 8/1992 | Burrows et al. | |
| 5,192,262 | A | | 3/1993 | Amendola et al. | |
| 5,248,031 | A | | 9/1993 | Burrows et al. | |
| 5,333,729 | A | | 8/1994 | Wolfe | |
| 5,375,722 | A | * | 12/1994 | Leary et al. | 493/128 |
| 5,531,233 | A | * | 7/1996 | Oglesby et al. | 131/69 |
| 5,542,529 | A | | 8/1996 | Hein, III et al. | |
| 5,558,743 | A | * | 9/1996 | Focke et al. | 156/352 |
| 5,595,803 | A | | 1/1997 | May et al. | |
| 5,657,609 | A | | 8/1997 | Spada et al. | |
| 5,682,986 | A | | 11/1997 | Cobler | |
| 5,724,786 | A | * | 3/1998 | Singh et al. | 53/64 |
| 5,876,502 | A | | 3/1999 | Sugimura et al. | |
| 5,899,128 | A | * | 5/1999 | Smithe et al. | 83/76 |
| 5,931,292 | A | | 8/1999 | Focke et al. | |
| 5,970,682 | A | * | 10/1999 | Focke et al. | 53/64 |
| 6,110,092 | A | | 8/2000 | Focke et al. | |
| 6,173,556 | B1 | * | 1/2001 | Willard | 53/571 |
| 6,338,410 | B1 | | 1/2002 | Wasmund | |
| 6,446,793 | B1 | | 9/2002 | Layshock | |
| 6,658,822 | B1 | | 12/2003 | Dittrich | |
| 6,673,152 | B2 | * | 1/2004 | Guzzon et al. | 53/383.1 |
| 6,694,708 | B2 | | 2/2004 | Brizzi et al. | |
| 6,712,906 | B2 | * | 3/2004 | Estelle et al. | 118/683 |
| 6,740,161 | B2 | | 5/2004 | Heide | |
| 7,118,792 | B2 | | 10/2006 | Hewitt et al. | |
| 2002/0022080 | A1 | | 2/2002 | Collin et al. | |
| 2003/0182904 | A1 | * | 10/2003 | Fields, Jr. et al. | 53/491 |
| 2005/0236282 | A1 | | 10/2005 | Huska | |
| 2006/0168909 | A1 | | 8/2006 | Miyaoka et al. | |
| 2006/0207224 | A1 | | 9/2006 | Ghini et al. | |
| 2007/0251984 | A1 | | 11/2007 | Bardet et al. | |

FOREIGN PATENT DOCUMENTS

| | | | | |
|---|---|---|---|---|
| GB | 2 132 975 | A | | 7/1984 |
| JP | 02235735 | A | * | 9/1990 |
| JP | 06226887 | A | * | 8/1994 |
| JP | 06305054 | A | * | 11/1994 |
| JP | 07255452 | A | | 10/1995 |
| WO | WO 91/10595 | | | 7/1991 |
| WO | WO 2004/037649 | A1 | | 5/2004 |
| WO | WO 2009/126417 | A2 | | 10/2009 |

OTHER PUBLICATIONS

Baumer hhs, Controller XT-E8/16 Information Sheet, 2 pages (2004).

Baumer hhs, Xmelt Brochure, 5 pages (2007).

Baumer hhs, Xmelt HM-500 Information Sheet, 4 pages (2007).

Baumer hhs, Xmelt HME 500 Information Sheet, 2 pages (2007).

PCT/US2009/037494 Invitation to Pay Additional Fees dated Jul. 2, 2009 (7p).

The International Search Report and Written Opinion of the International Searching Authority for PCT/US2009/037494, dated Dec. 21, 2009, (19p).

G.D. S.p.A., Schematic Illustration of the G.D. X2 Cigarette Packaging Machine, Mar. 1988, 1 page, Bologna, Italy.

Henkel Adhesives, Technical Information Sheet for Product 37-613, 1 page.

KEYENCE, FS-V20 Series Dual Digital Display Amplifier Specification Sheet, 2 pages.

KEYENCE, FU-2303 Fiber Optic Sensor Information from KEYANCE.com, 1 page.

National Adhesives, National Starch and Chemical Company, Technical Information Sheet for UNI-FLEX 70-007A, 1 page.

National Starch and Chemical Material, Safety Data Sheet for Product 70-007A, May 22, 2003, 5 pages.

SunCure Coatings, UV Coatings for Web Heatset Cover Applications Information Sheet, 1 page (2005).

* cited by examiner

Fig. 2A
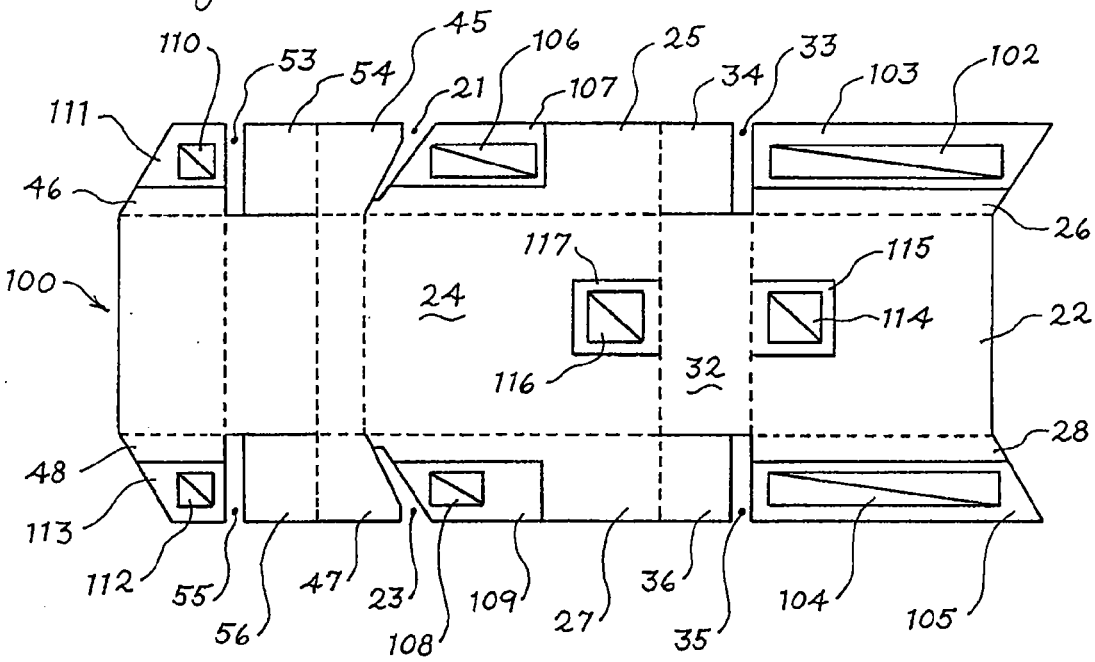
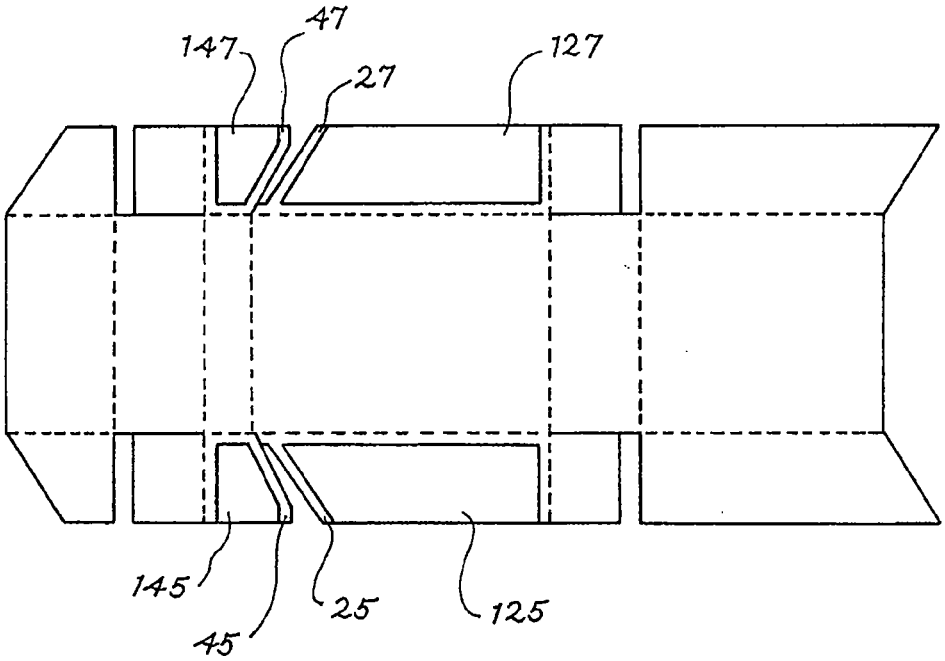
Fig. 2B

EQUIPMENT FOR MANUFACTURING CIGARETTE PACKAGES

This application is a divisional of U.S. patent application Ser. No. 12/101,529, filed Apr. 11, 2008, now U.S. Pat. No. 7,762,046, the disclosure of which is incorporated herein by reference.

BACKGROUND

The present invention relates to tobacco products, such as smoking articles, and in particular, to packages for containing tobacco products.

Popular smoking articles, such as cigarettes, conventionally have been sold in packages. Typically, each full package contains about 20 cigarettes. Cigarettes have been packaged in containers known as so-called "soft-packs." See, for example, U.S. Pat. No. 3,695,422 to Tripodi; U.S. Pat. No. 4,717,017 to Sprinkel, Jr., et al.; and, U.S. Pat. No. 5,333,729 to Wolfe; which are incorporated herein by reference. Cigarettes have also been packaged in containers known as so-called "hard-packs" or "crush proof boxes." See, for example, U.S. Pat. No. 3,874,581 to Fox et al.; U.S. Pat. No. 3,944,066 to Niepmann; and, U.S. Pat. No. 4,852,734 to Allen et al.; which are all incorporated herein by reference.

Various modifications have been proposed to the so-called "hard pack" cigarette package designs to enhance the consumer acceptance of the package. For example, it has been disclosed to round off the portions leading to the corners of the package to yield a "pillow-type" cigarette package, such has been disclosed in U.S. Pat. No. 6,694,708 to Brizzi et al. which is incorporated herein by reference. Alternatively, it has been disclosed to provide multiple methods of accessing the cigarettes. For example, U.S. Pat. No. 5,682,986 to Cobler, U.S. Pat. No. 5,139,140 to Burrows et al., and U.S. Pat. No. 5,248,031 to Burrows et al., which are herein incorporated by reference, disclose a removable portion of the lid of a hard-pack thereby providing for soft-pack style accessibility in addition to the hard-pack flip-top. In addition to these structural modifications, it is desirable to develop more attractive packaging for cigarettes.

SUMMARY

Systems and methods for manufacturing at least partially transparent containers for smoking articles from materials not traditionally used in packaging smoking articles are provided. The invention may include any of the following aspects in various combinations and may also include any other aspect described below in the written description or in the attached drawings.

One embodiment of the present invention relates to a system for manufacturing a container for smoking articles, such as cigarettes. This embodiment of the system includes a hopper that holds container blanks, a gear train that is coupled to and drives a feed belt, a hot-melt adhesive applicator, an encoder coupled with the gear train and configured to track the translational movement of the blanks through the system, an electronic blank sensor approximately opposite from the hot-melt adhesive applicator, and an electronic control unit in communication with the encoder, the electronic blank sensor, and the hot-melt adhesive applicator. In operation, the feed belt moves blanks from the hopper to the hot-melt adhesive applicator. As blanks enter the hot-melt adhesive applicator, the blank sensor signals the electronic control unit, which causes the hot-melt adhesive applicator to apply a pre-determined pattern of adhesive to the blank. After the hot-melt adhesive applicator glues the blank, the blank passes to a folding station which is configured to fold the blank into a container about an assemblage of smoking articles.

One embodiment of a representative method of manufacturing a transparent or partially transparent container for smoking articles includes providing a blank of a transparent material, feeding the blank to a hot-melt adhesive applicator, applying hot-melt adhesive to selected portions of the blank, and folding the blank so that at least some of the selected portions are pressed against corresponding portions of the blank, to form a container with an interior volume for receiving smoking articles.

BRIEF DESCRIPTION OF SEVERAL VIEWS OF THE DRAWINGS

The invention may be more fully understood by reading the following description in conjunction with the drawings.

FIG. 2A shows a plan view, looking at the inside surface, of an embodiment of a container blank that may be used in an embodiment of the present invention.

FIG. 2B shows a plan view, looking at the opposite surface, of the embodiment of the container blank shown in FIG. 2A.

DETAILED DESCRIPTION

Figure 1:
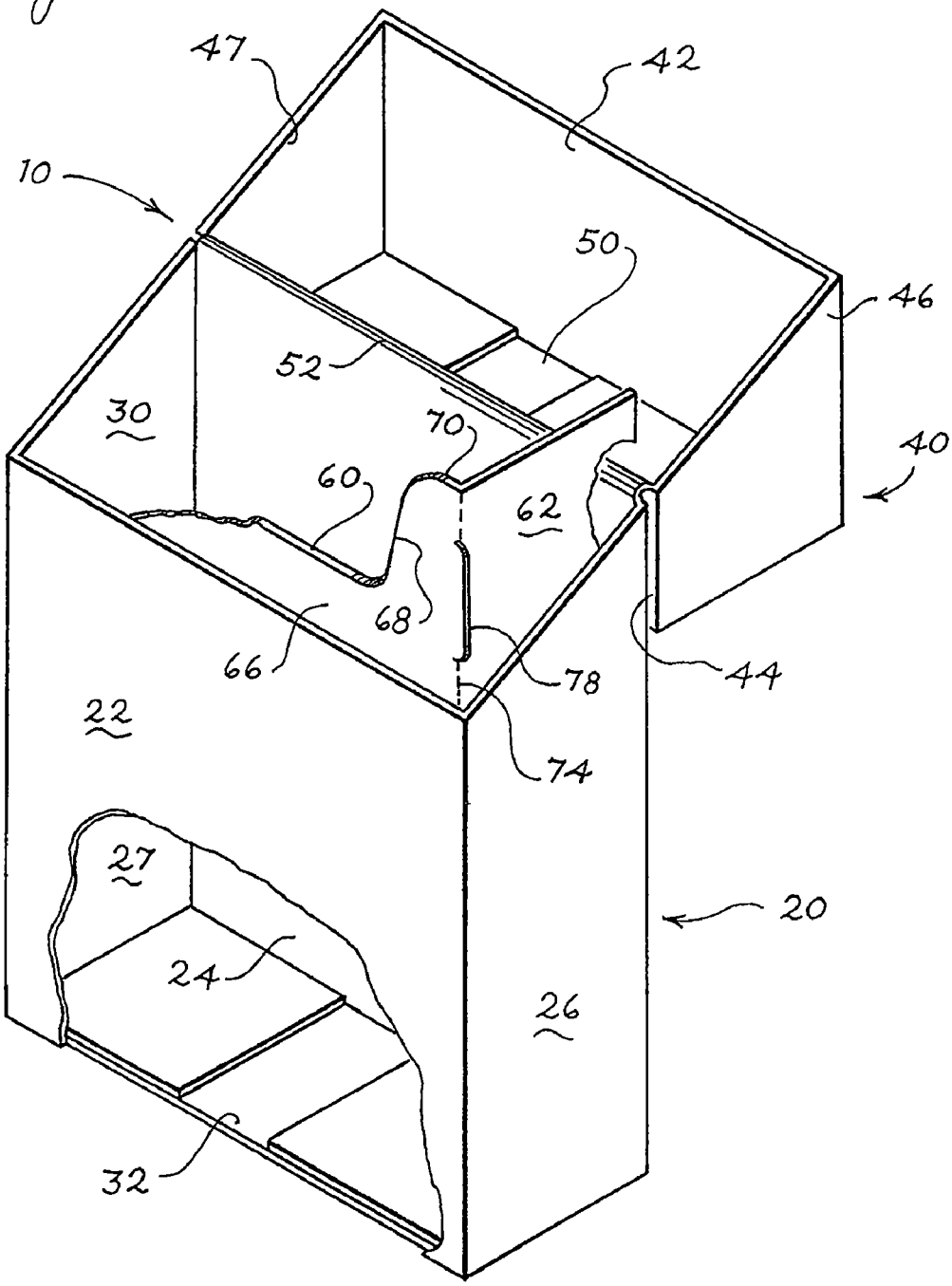
FIG. 1 shows a front perspective view of an assembled package according to an embodiment of present invention.

For the sake of simplicity, the same reference number is used for any common part shown in any of the various figures throughout this Detailed Description. Referring to FIG. 1, there is shown a front perspective of various components of an assembled container 10 that is representative of one embodiment of the present invention. For clarity, a portion of the front wall 22 is shown cut away, as is a portion of the inner frame insert 60. The container 10 includes an outer body portion 20 and a lid portion 40 and an inner frame insert 60. The body portion 20 includes a front wall 22, a back wall 24, a right side wall 26 connecting the front wall 22 to the back wall 24, a left sidewall 28 (visible in FIG. 2A) connecting the front wall 22 to the back wall 24, and a bottom wall 32 that closes the opening formed by the front wall 22, back wall 24, right side wall 26 and left side wall 28. The front wall 22, back wall 24, right side wall 26, left side wall 28, and bottom wall 32 together form a volume closed at one end and having a rectangular cross-section. The body 20 forms a top opening 30 opposite the bottom wall 32.

A lid 40 is formed having a front wall 42, a back wall 44, a right wall 46 that connects the front wall 42 and back wall 44, and a left wall 48 (visible in FIG. 2A) that also connects the front wall 42 and the back wall 44. The lid 40 defines a rectangular cross-section of similar size and shape to the cross-section of the body 20. The lid includes a top wall 50 closing off the rectangular cross section. Preferably, the lid 40 is hingedly attached to the body 10 by a hinge 52 that is integral with the back wall 24 of the body 20 and the back wall 44 of the lid 40. The hinge 52 is preferably formed by a crease or scoring or perforation in the material of the back wall 24 of the body and the back wall 44 of the lid. The hinge delimits each back wall 24 and 44.

Preferably, the lid 40 is integrally connected with the body 20 as shown in FIG. 1, so that it may be movable between an open position and a closed position without being physically separated from the body 20. However, those skilled in the art understand that the lid 40 may be composed of a separate portion that is hingedly connected to the body 20 by extra tab portions. These tab portions may be adhesively or otherwise connected to the inner surfaces of the body 20 and lid 40 portions. The lid 40 most preferably is adapted to cooperate with the body 20 portion, and hence, act to cover the top region of the body 20 portion (e.g., the lid 40 can fit over the top region of the body 20 portion, and can be maintained in place, such as by friction fit between the outer surface of the inner frame insert 60 and the inner surface of the inner side walls 45 (visible in FIG. 2A) and 47 of the lid 40, such as in the manner described above), and hence, provide the container 10 in a closed configuration. The lid 40 preferably is movable relative to body portion 20, in order to provide a container 10 that is in an opened or closed configuration.

Figure 4:
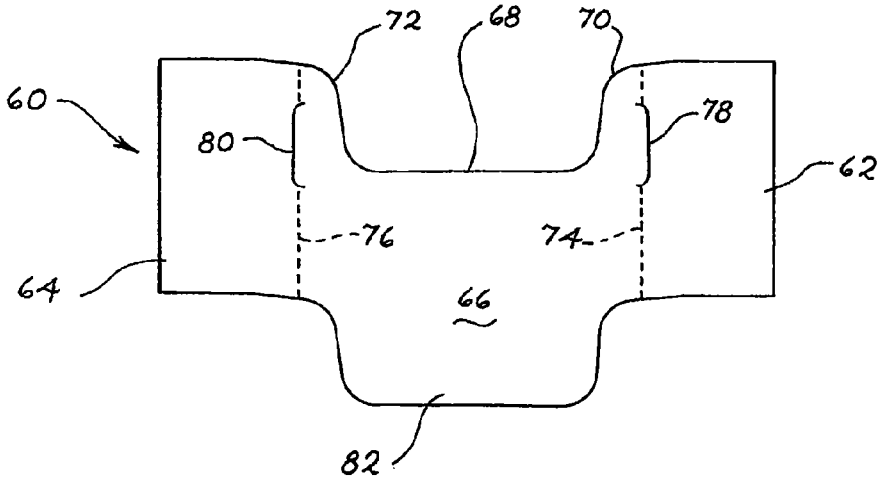
FIG. 4 shows a plan view of an embodiment of an inner frame insert prior to assembly of the container.

As shown in FIGS. 1 and 4, the inner frame insert 60 (collar) of the assembled container 10 includes a right sidewall 62 and a left side wall 64, and a front wall 66 connecting the right side wall 62 and left side wall 64. Centered in the front wall 66 of the insert is a lowered portion 68, which exposes the wrapping material and allows for easier removal of all or a portion of the wrapping material and the smoking articles. A right shoulder portion 70 and a left shoulder portion 72 are disposed to the right and left of the lowered portion 68, and these shoulder portions 70 and 72 extend to a height above the lowered portion 68. The inner frame insert 60 is positioned in the body 20 such that the front wall 66 of the insert 60 is substantially flush with the inside surface of the front wall 22 of the body 20. The right and left side walls 62 and 64 of the inner frame insert 60 are substantially flush with the inside of the inner right and left side walls 25 (visible in FIG. 2A) and 27 of the body 20. The inner frame insert 60 extends above the top opening 30 of the body 60 such that the right and left shoulder portions 70 and 72 are just below the top wall 50 of the lid 40 when the lid 40 is in a closed position. The inner frame insert 60 is preferably adhesively attached along its right and left side walls 62 and 64 to the right and left inner side walls 25 and 27 of the body 20. In each of the corners 74 and 76, friction tabs or ears 78 and 80 extend outwards from the right and left walls 62 and 64 in the plane of the front wall 66. These friction tabs 78 and 80 provide frictional contact with the inner surface of the right and left inner side walls 45 (visible in FIG. 2A) and 47 of the lid to assist in keeping the lid 40 in a closed position over the inner frame insert 60 and adjacent to the body 20.

Referring to FIG. 4, there is shown an unfolded inner frame insert 60. The inner frame insert 60 consists of a right side wall 62 and a left side wall 64 connected by a front wall 66. The fold lines 74 and 76 between the right side wall 62 and the front wall 66, and the left side wall 64 and the front side wall 66 are illustrated as dashed lines in FIG. 4. The right and left fold lines 74 and 76 are preferably scored or micro-perforated, but they may alternatively be creased or formed using methods known to those skilled in the art. Each fold line 74 and 76 includes a friction tab 78 and 80 as described in association with FIG. 1. The embodiment illustrated in FIG. 4 shows a depending base portion 82 of the front wall 66. The depending base portion 82 may be the same width as the lowered portion 68. The length of the inner frame insert 60 from the bottom of the depending base portion 82 to the top of the shoulder 72 may be adjusted. In some embodiments, a longer inner frame insert 60 may be used to help reinforce the front wall 22 (visible in FIG. 1) of the container. Additionally, longer inner frame inserts 60 may allow the edge of the depending base portion 82 to be placed flush with the bottom of the container and thus hidden from view. The inner frame insert 60 may be produced by the packaging machine in the conventional manner known to those skilled in the art. However, producing longer inner frame inserts may require costly modifications to the packaging machine. While the preferred embodiment discussed features a separate inner frame insert 60, it is understood that such insert could be formed integrally with the blank as disclosed in U.S. Pat. No. 3,874,581 to Fox et al., which was previously incorporated by reference.

Figure 3:
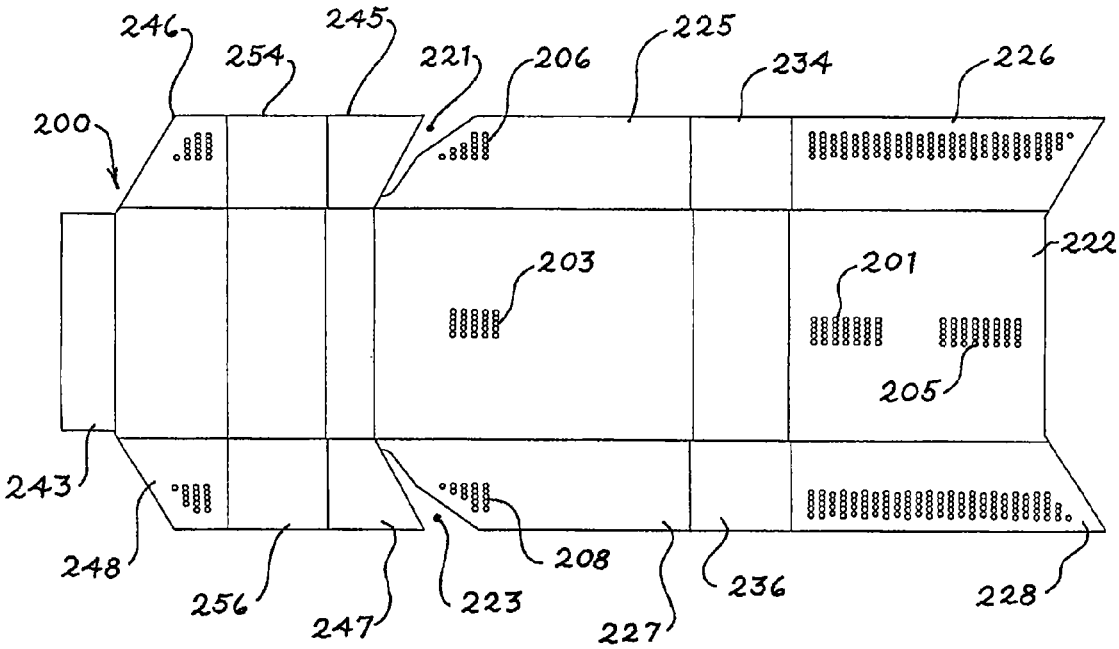
Fig. 3 (PRIOR ART)
FIG. 3 shows a plan view of an example of a prior art paperboard blank.

Referring to FIG. 2A, there is shown a view of the blank 100 from which one embodiment of the container 10 in FIG. 1 is formed. The blank 100 is formed from a substantially rectangular piece of material. Preferably, this material is a transparent material, as discussed below. Selected areas 102, 104, 106, 108, 110, and 112 represent the preferred areas to which adhesive is applied (adhesive areas or selected areas). In contrast to the prior art paperboard blank illustrated in FIG. 3, the embodiment shown in FIG. 2A may not include adhesive areas in the front and back walls. Desirably, adhesive is not visible in the transparent unprinted regions of the blank 100. As known in the art, the adhesive areas 201 and 203, visible in FIG. 3, provided a method of attaching the wrapped assemblage of smoking articles to the container material. The adhesive regions 205, 206 and 208 in the prior art blank 200 provided an adhesive connection between the inner frame insert piece and the container material. In the embodiment of the present invention shown in FIG. 2A, the transparent inner frame insert 60 (visible in FIGS. 1 and 4) is attached to the container material by adhesive areas 106 on right inner side wall 25 and 108 on left inner side wall 27. The inner side walls 25 and 27 are integrally attached to the back wall 24. The right and left cut away spaces 21 and 23 between the right and left inner lid side walls 45 and 47 and the right and left inner side walls 25 and 27 of blank 100 are smaller than the right and left cut away spaces 221 and 223 in the prior art paperboard blank 200 shown in FIG. 3. The smaller right and left cut away spaces 21 and 23 allow for larger adhesive areas 106 and 108, and a better connection with the inner frame insert 60, while still providing sufficient tolerance between the tops of inner side walls 25 and 27 and outer side walls 26 and 28 when the blank 100 is folded. Right adhesive area 106 extends further towards the bottom wall 32 such that it extends below the bottom of the inner frame insert 60 and may thereby provide an adhesive connection to the wrapped assemblage of smoking articles. In some embodiments, the left adhesive area 108 may be extended instead of the right adhesive area 106, or both may be extended. Adhesive areas 114 on the front wall 22 and 116 on the back wall 24 may be included in some embodiments to assist in attaching the foil wrapped assemblage of smoking articles. However, these additional adhesive areas 114 and 116 are optional and may be omitted to help prevent the hot-melt adhesive from being transferred to other parts of the packaging machine.

In a preferred embodiment, the blank 100 may be covered on the inside and outside surfaces with a coating of a varnish material. Advantageously, this varnish material may reduce or eliminate the build up of static, which may help prevent multiple blanks 100 from sticking together and being fed from the hopper 610 (visible in FIG. 5) simultaneously. In one preferred embodiment, the varnish applied to the inside surface of the blank 100 is applied so that varnish free areas 103, 105, 107, 109, 111, and 113 are located in and around the adhesive areas. In embodiments including adhesive areas 114 and 116 in the front wall 22 and back wall 24, respectively, additional varnish free areas 115 and 117 may be included. FIG. 2B shows a plan view of the outside surface of an embodiment of the blank 100. As shown in FIG. 2B, the outside surfaces of the right and left inner side walls 25 and 27 may include varnish free areas 125 and 127. Similarly, the right and left lid inner side walls 45 and 47 may include varnish free areas 145 and 147. These varnish free areas 125, 127, 145, and 147 correspond to the adhesive areas 102, 105, 106, and 108 in the container made from the folded blank 100. The varnish free areas may improve the bonding formed by the hot-melt adhesive material. However, those skilled in the art understand that the varnish-free areas may be omitted, or, alternatively, the varnish may be omitted.

As shown in FIG. 2A, corresponding portions 25, 27, 45, and 47 represent the preferred areas to which the selected areas are folded and pressed. Right adhesive area 102 on the right side wall 26 and left adhesive area 104 on the left side wall 28 are ultimately attached to the right and left inner side walls 25 and 27 once folded. When the blank 100 is folded, right adhesive area 110 on the right lid side wall 46 and left adhesive area 112 on the left lid side wall 48 are attached to the right and left inner lid side walls 45 and 47, respectively.

The solid lines in FIG. 2A represent cut lines, whereas the dashed lines represent fold lines. In one embodiment, the fold lines are scored or micro-perforated to help relieve stresses and enable better folding of the blank 100. The embodiment shown in FIG. 2A includes several modifications over the prior art blanks, such as the representative embodiment 200 shown in FIG. 3. As can be seen, the prior art blank includes a reinforcing lid flap 243, whereas the embodiment shown in FIG. 2A eliminates this additional portion. The advantages of eliminating the lid tuck flap 243 will be discussed below. To enable proper feeding and handling of the blank using packaging machines such as the G.D. X2, the right and left bottom dust flaps 34 and 36 as well as the right and left lid dust flaps 54 and 56 are modified. Right and left bottom interlock cutout portions 33 and 35 are preferably rectangular-shaped and cut away from the right and left bottom dust flaps 34 and 36. Similarly, right and left lid interlock cutout portions 53 and 55 are preferably rectangular-shaped and cut away from the right and left lid dust flaps 54 and 56. These interlock cutouts 33, 35, 53, and 55 help prevent the blanks in the hopper 610 from sticking together and causing multiple blanks to be fed together. In one embodiment the right and left lid interlock cutout portions 53 and 55, and the right and left bottom interlock cutout portions 33 and 35 have widths of approximately 3-6 mm.

To achieve proper gluing using the hot-melt adhesive and applicator 542 coupled to a cigarette packaging machine such as the G.D. X2, it is preferred to keep the blanks 100 as flat as possible. Accordingly, it is desirable to eliminate residual stresses that may arise in cutting and micro-perforating the blanks. Eliminating the lid tuck flap (lid 180 degree fold-over flap) 243, and the 180 degree fold it requires, from blank 100 helps reduce stresses that may affect the gluing and folding as well as the functionality of the lid portion of the modified blank 100.

The prior art paperboard blank shown in FIG. 3 differs from the embodiment of the blank 100 shown in FIG. 2A in numerous ways. For example the right and left lid dust flaps 254 and 256 span the full distance from the side lid flaps 246 and 248 to the inner lid side walls 245 and 247. Similarly, the bottom lid flaps 234 and 236 span the full distance from inner side walls 225 and 227 to outer side walls 226 and 228. Furthermore, adhesive areas 205, 206, and 208 on the front wall 222 and right and left inner side walls 225 and 227 are used only to attach the inner frame insert. Whereas, adhesive areas 203 and 201 are used to attach the foil wrapped assemblage of smoking articles. Additionally, the top edges of the right and left inner side walls 225 and 227 are shaped differently in the paperboard blank so that the cut away spaces 221 and 223 are larger than the cut away spaces 21 and 23 in the transparent blank 100 shown in FIG. 2A. As noted above, the smaller cut away spaces 21 and 23 in the blank 100 shown in FIG. 2A provide more space for larger adhesive areas 106 and 108 and thus allow for a more secure connection with the inner frame insert 60.

The body 20 and lid 40 shown in FIGS. 1 and 2A are preferably formed of a sheet made from a transparent material, such as a plastic. In one embodiment, an amorphous polyethylene terephthalate (APET) material such as Pentafood® FD 670/70 from Klockner Pentaplast of Gordonsville, Va. may be used. In another embodiment, polyethylene terephthalate glycol (PETG) or polyethylene terephthalate-glycol-amorphous glycol (PET-GAG) may be used. In yet another embodiment, the body 20 and lid 40 may be formed from other transparent materials. Preferably, the inner frame insert is also made from the same transparent material.

Although the preferred container and associated components are formed from transparent plastic materials, such as an APET material, the container and other certain associated components can be constructed from a variety of other materials. For example, those components can be constructed from composite materials, laminated materials, or the like. Typically, the thickness of the blank material is in the range of about 0.25 millimeter to about 0.40 millimeter. In one embodiment, the thickness of the blank material used to construct the outer body and the lid of the container is about 0.28 millimeter to about 0.36 millimeter. In another embodiment, the thickness of the blank material is about 0.30 millimeter. Although not required, generally the thickness of the material used to construct the inner frame insert portion of the container is the same thickness as the body of the container.

In the preferred embodiment, the adhesive is applied in areas on the opposite side of the blank 100 that feature printed designs. In one embodiment, a transparent hot-melt adhesive is used to affix the selected overlapping (corresponding) portions of the blank 100. The hot-melt adhesive may be a pressure sensitive hot-melt adhesive, which is preferably non-solvent based and contains 100 percent solids. In a preferred embodiment, the hot-melt adhesive material conforms to food grade regulations in compliance with 21 C.F.R. §175.105. In one embodiment, the hot-melt adhesive may contain Styrene-Butadiene-Styrene (SBS) polymer with plasticizers, tackifiers, waxes, and/or stabilizers. However, those skilled in the art will understand that other polymer materials may be used. In another embodiment, the hot-melt adhesive is a pressure sensitive, quick setting adhesive such as Primamelt® 37-613 from Henkel Adhesives of Elgin, Ill., or Uni-Flex® 70-007A from National Starch and Chemical Company of Bridgewater, N.J. However, other adhesive materials may be used as is apparent to those skilled in the art. Preferably, a transparent, pressure-sensitive, quick setting adhesive that is compatible with the blank material is used.

The texture of the applied adhesive in the areas in FIG. 2A differs from the texture of the applied adhesive in the areas in the prior art illustrated in FIG. 3. In FIG. 2A, the adhesive is shown as applied in continuous strips. In the prior art example of FIG. 3, a polyvinyl acetate glue is shown as applied on paperboard using, for example, a gravure glue wheel applicator. As visible in FIG. 3, the adhesive was not applied uniformly or continuously but instead in selected locations, such as in a non-continuous polka-dot pattern, that correspond to the texture of the gravure applicator. A gravure wheel gluing apparatus may not provide desirable gluing for the transparent materials considered for the embodiments of the present invention. Furthermore, a gravure glue wheel applicator may not be compatible with the preferred adhesive materials. Therefore, it may be desirable to modify the packaging machine as described below.

As described above, varnish materials may be used to reduce static build-up among the blanks and to prevent simultaneous blanks from being fed from the hopper. Preferably the varnish material used is a flexible, high gloss, UV-curable, top lacquer with low sensitivity to static charge. In one embodiment, the varnish is of the type described above such as SunCure LO 7500T from Sun Chemical of Parsippany, N.J. However, those skilled in the art and following the teachings herein will understand that other varnish materials may also be used.

Figure 5:
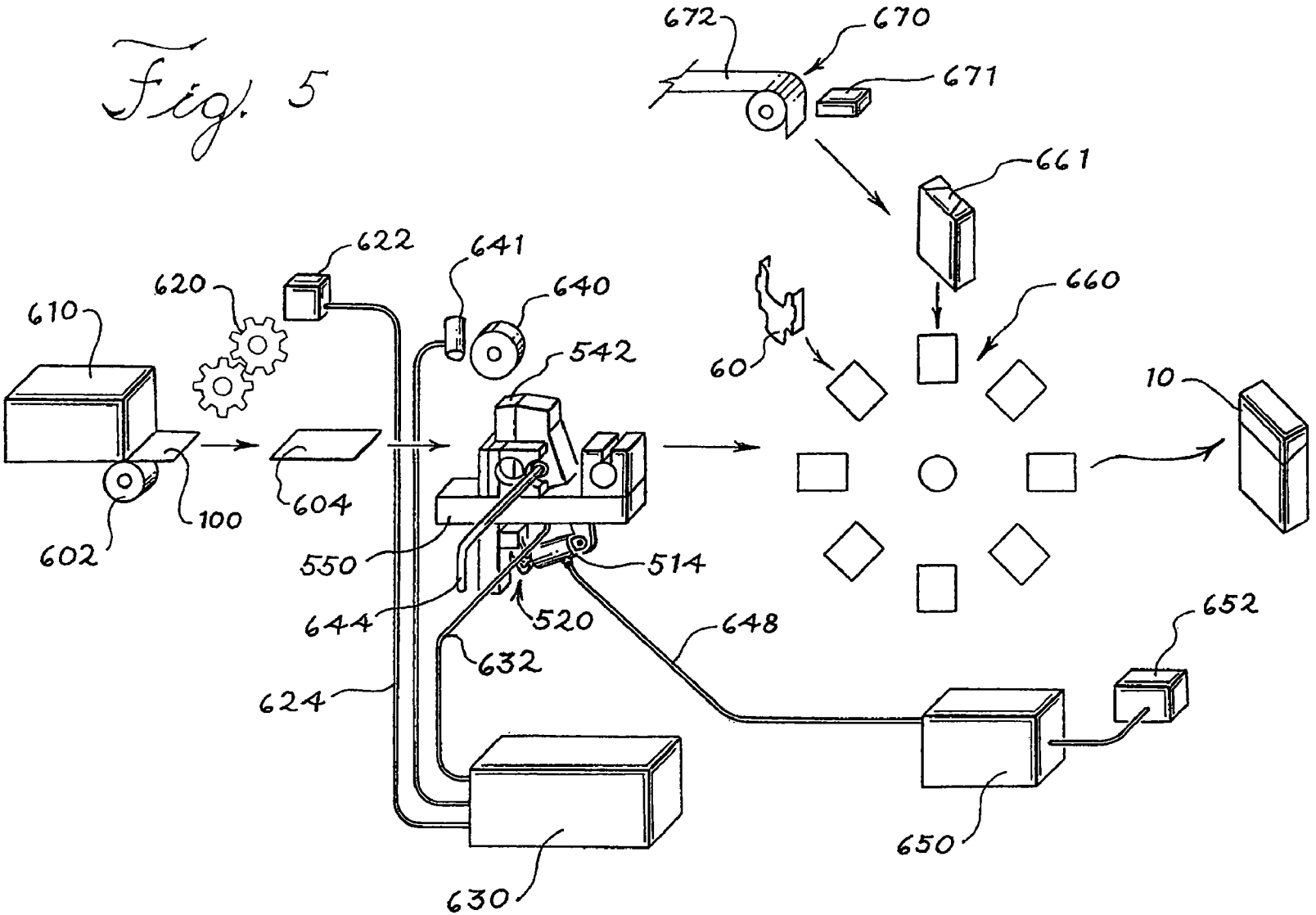
FIG. 5 shows a schematic representation of a blank passing through a cigarette packaging machine.

In a preferred embodiment, a commercially available cigarette packaging machine, such as the G.D. X2 from G.D. SpA of Bologna, Italy or the 350S from Focke & Co. of Verden, Germany, is modified to form packages made of a transparent plastic material instead of paperboard. The G.D. X2 cigarette packaging machine is described in U.S. Pat. No. 6,694,708, which is herein incorporated by reference. FIG. 5 is a schematic representation of a packaging machine to make the transparent container described above. The packaging machine for assembling the packages of the present embodiment is modified by replacing the gravure glue wheel applicator with a hot-melt adhesive applicator 542. Furthermore, the textured contrast wheel used with the gravure applicator is replaced with a uniform contrast roller 640 to apply uniform pressure to the area of adhesive application. With hot-melt adhesive it is preferable to apply a thin layer of adhesive in order to prevent the material from extruding out the sides of the overlapping portions and contacting other parts of the blank or parts of the packaging machine. Because the hot-melt adhesive applicator 542 receives a pressurized feed of hot-melt adhesive, it is preferable to maintain uniform pressure between the blank and the applicator. The uniform contrast roller 640 is used in the preferred embodiment to allow for a uniformly thin application of adhesive. In one embodiment, the spacing between the hot-melt adhesive applicator 542 and the uniform contrast roller 640 is between about 0.27 millimeters to about 0.44 millimeters. However, this spacing may vary depending on the thickness of the material used for the container blank 100 and also the type of hot-melt adhesive used.

Figure 6:
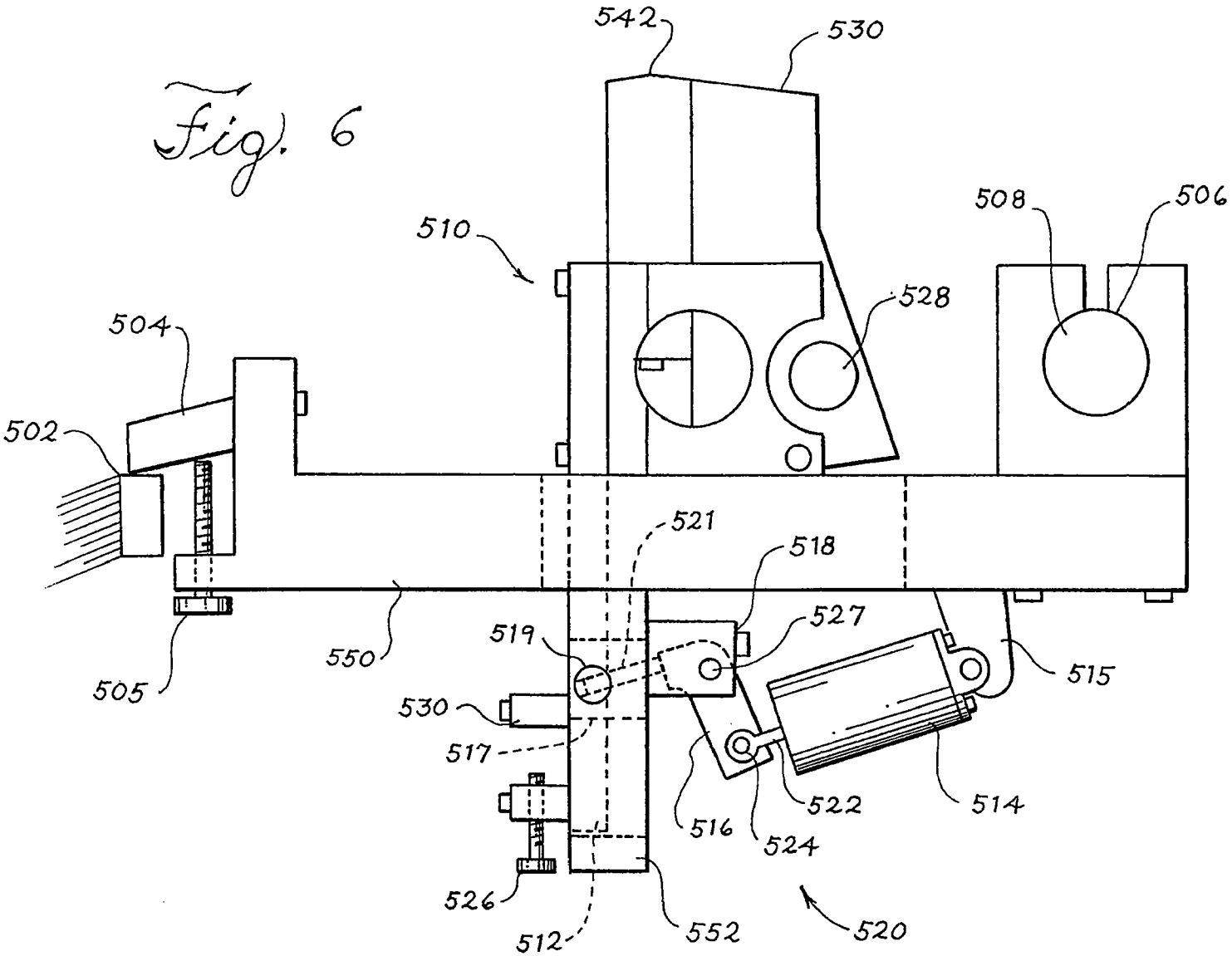
FIG. 6 shows a side view of an adhesive applicator and mounting frame.

To achieve the desired adhesive pattern, it may be desirable to attach several hot-melt applicators 542 to a manifold 530 (visible in FIG. 6). For example, in one embodiment, three hot-melt adhesive applicators 542 are attached to a manifold 530 in order to replicate the gluing pattern of the stock gravure glue wheel applicator. Hot-melt adhesive applicators, such as the HME-500F from Baumer hhs of Krefeld, Germany, may be used to apply the hot-melt adhesive. Those skilled in the art following the teachings herein may recognize that other applicators may be used as well.

In one embodiment, an encoder device 622, such as a Series H35 Sealed Hollow Shaft Encoder from Dynapar of Gurnee, Ill., is coupled to the gear train 620 of the cigarette packaging machine. The gear train 620 drives the translational movement of the container blanks 100 through the cigarette packaging machine. The encoder 622 tracks the translational movement of the blanks 100 through the packaging machine and assembly process based on readings taken from the gear train 620. The encoder 622 is in electronic communication with an electronic control unit 630 for the hot-melt adhesive applicator 542. The electronic control unit 630 is used to control the pattern of hot-melt adhesive applied by the applicators 542. Furthermore, the electronic control unit 630 may be used to adjust the feed pressure to apply the proper amount of adhesive based on a variety of system parameters including the feed rate of blanks into the packaging machine. Typically, a machine such as the G.D. X2 may operate at a feed rate of up to about 400 blanks per minute, or more often up to about 300 blanks per minute, or most often between 150 and 250 blanks per minute. The electronic control unit 630 may be a model XT-E4 glue control unit from Baumer hhs of Krefeld, Germany. However, other control units may be used. Additionally, the electronic control unit 630 may be coupled to a hot melt adhesive tank and pump, for example a model HMP-08 Promelt tank and pump from Baumer hhs of Krefeld, Germany.

In some embodiments, an electronic blank sensor 641 may be placed adjacent to the uniform contrast roller 640 to assist in initiating adhesive control. The electronic blank sensor may assist the electronic control unit 630 in achieving a more precise adhesive application pattern by providing precise information regarding when each blank enters the hot-melt adhesive applicator 542. Information is received by the electronic control unit 630 from the electronic blank sensor 641 to supplement translational movement information received from the encoder device 622 to enable precise adhesive application patterns. In one embodiment, the electronic blank sensor may be an amplifier and fiber optic sensor. In another embodiment, the electronic blank sensor may be a model FU-2303 fiber optic sensor and FS-V20 Series Digital Display Amplifier from Keyence Corporation of America, Woodcliff Lake, N.J. Those skilled in the art and following the teachings herein will understand that other electronic sensors may be used for the electronic blank sensor.

In some embodiments, the hot-melt adhesives have application temperatures between about 145 to 180 degrees Celsius, thus causing the applicator 542 to have a similar temperature. Many of the transparent plastic materials that may be used to form transparent containers for smoking articles have relatively low melting temperatures. To prevent container blanks from melting to the hot-melt adhesive applicator 542 when the packaging machine stops, it may be desirable to lift the hot-melt adhesive applicator 542 into an operating position when the machine is running and then to retract the applicator 542 when the machine is stopped.

Referring to FIG. 6, the hot-melt adhesive applicator 542 may be mounted to a frame assembly 550 designed to correspond to the mounting arrangement of the stock gluer in the cigarette packaging machine, such as the gravure glue wheel of the G.D. X2. In one embodiment, the hot-melt adhesive applicator 542 is attached to a frame 550 having connections that correspond to the pattern of connections for the stock glue pot to the G.D. X2 or whichever packaging machine has been modified. In this embodiment, the frame 550 includes a stabilizing bar 504 designed to slide over a rail component 502 of the packaging machine. A tightening screw 505 may be included to clamp the frame assembly 550 and the stabilizing bar 504 against the rail component 502. On the other side of the frame 550, a cylindrical opening 506 is provided to slide over a post portion 508 of the packaging machine.

While the frame 550 remains stationary once mounted onto the packaging machine, a mounting assembly 510 for the hot-melt adhesive applicator 542 may lift into a gluing position or retract into an off position. The mounting assembly 510 includes a slider plate 512. The slider plate 512 slides within an opening 513 (visible in FIG. 7) between two vertical portions 552 of the frame 550. The mounting assembly 510 is positioned by the lever-type action of a movable support 520 composed of a pneumatic cylinder 514 coupled to a lever 516 that is pivotably mounted in a connecting block 518. The pneumatic cylinder 514 is connected to the frame 550 at a depending tab 515, which is located at the end opposite the driving rod 522.

In operation, the movable support 520 moves the hot-melt adhesive applicator 542 in response to pneumatic pressures received from a pneumatic pump 650 (visible in FIG. 5). The pneumatic pump 650 causes the movable support 520 to lift to an operating position or retract to a non-operating position based upon signals received from the system processor 652 (visible in FIG. 5) for the packaging machine. When the packaging machine is first turned on, and a first blank 100 enters the system, the system processor 652 sends a lifting signal. When the packaging machine is stopped, the system processor 652 sends a retracting signal. Unlike the contrast wheels used with the stock gravure gluer, the uniform contrast wheel 640 (visible in FIG. 5) used with the hot-melt adhesive applicator 542 is placed in a fixed location. Therefore, the signal originally sent by the system processor 652 to move the contrast wheel may be used to signal the movable support 520. Alternatively, the system logic may be modified to send a raising and lowering signal. When the activating signal is received, the pneumatic cylinder 514 extends its driving rod 522, which drives the lever 516 into an extending position. The lever 516 includes a cylindrical post 521 at its distal end. The slider plate 512 includes a rotating pin 519 that spans an opening 517 in the slider plate. The rotating pin 519 includes a hole 523 (visible in FIG. 7) into which the cylindrical post 521 slides. As the driving rod 522 extends, the lever 516 rotates about the connection 524 with the driving rod 522 and the pivot pin 527 in the connecting block 518. The cylindrical post 521 at the distal end of the lever 516 raises the slider plate 512 by sliding in the hole 523 and driving the rotating pin 519 upwards. The lifting action drives the hot-melt adhesive applicator up about 9 to 16 millimeters. Both the top and bottom positions may be set through use of adjustable stops 526. A block 530 may be included on the vertical depending portions 552 which blocks the adjustable stop 526 and limits the lifting height of the moveable support 520.

Figure 7:
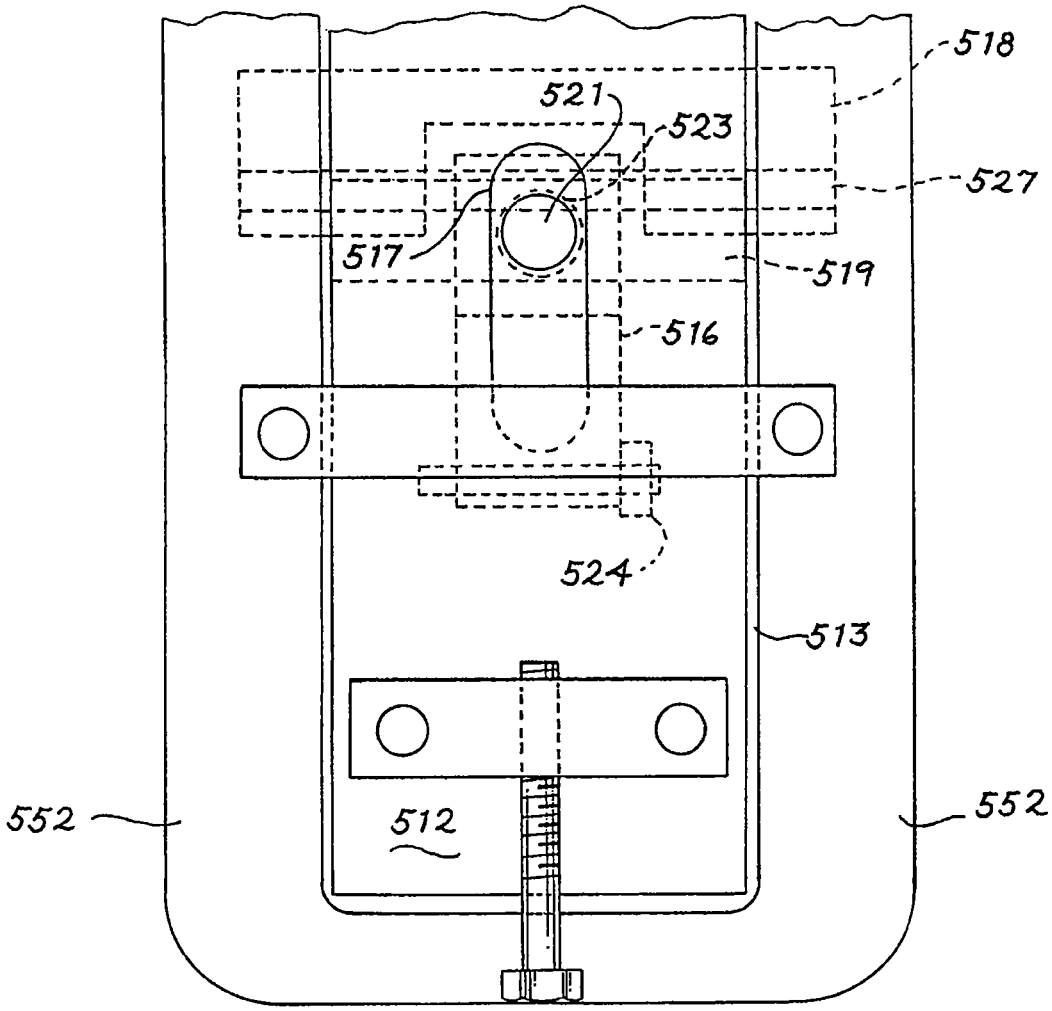
FIG. 7 shows a front expanded view of a slider plate and depending portion of an adhesive applicator frame.

Referring to FIG. 7, a front view of the slider plate 512 and depending vertical portions 552 of the frame assembly 550 (visible in FIG. 6) is shown. The sliding plate 512 fits in opening 513 between the depending vertical portions 552 and slides in response to the lever action of the lever 516. As described above, the rotating pin 519 in the sliding plate 512 contacts the cylindrical post 521 of the lever 516 an opening 517. As the pneumatic cylinder 514 (visible in FIG. 6) extends the rod 522 (visible in FIG. 6), the connection 524 pushes the lever 516 by driving rod 522. In turn, this causes the lever 516 to rotate about the pivot pin 527 in the connecting block 518, and cylindrical post 521 at the distal end of the lever 516 to push the sliding plate 512 up by pushing against the inside surface of the hole 523 in the rotating pin 519 spanning the opening 517.

Referring now to FIG. 5, due to the design of the modified blank 100, the hopper 610 may be modified. In one embodiment, additional approximately vertical guide posts are placed along the longer sides of the blank 100 to help keep the blanks 100 in an orderly arrangement in the hopper 610. Additionally, a solid side support may be placed between the guide posts on at least one of the longer sides of the blank 100. Advantageously, this solid side support may include a textured finish to help prevent multiple blanks 100 from being fed simultaneously into the system.

In operation, the modified cigarette packaging machine schematically presented in FIG. 5 starts by sending individual blanks 100 from a hopper 610 into the machine using a transfer device 602, such as a transfer wheel or a suction cup. The transfer device 602 places individual blanks 100 into a lugged transfer belt or feed belt 604. Due to the modified shape of the blank 100, it may be desirable to include guides in the machine, along the feed belt 604, between the hopper and the adhesive applicators 542.

The gear train 620 drives the translational movement of the blank 100 throughout the machine. As noted above, the encoder 622 coupled to the gear train 620 tracks the translational movement of the blank and sends data to an electronic control unit 630 via a communication line 624. The electronic control unit 630 converts data from the encoder 622 to instructions for the hot-melt adhesive applicator 542, and sends the instructions to the hot-melt adhesive applicator 542 via a second communication line 632. The hot-melt adhesive applicator 542 receives hot-melt adhesive via an insulated feed line 644 that connects to adhesive port 528 (visible in FIG. 6) on the manifold 530 (visible in FIG. 6). When in operation, the hot-melt adhesive applicator 542 is raised to an operating position by a movable support 520, in this case a pneumatic cylinder 514 that receives pneumatic pressures via lines 648, a lever 516 (visible in FIG. 6), and a connecting block 518 (visible in FIG. 6). When a blank 100 enters the gluing area down flow from the hopper 610, the electronic control unit 630 signals the hot-melt adhesive applicator 542 to apply a pre-determined pattern of hot-melt adhesive. The uniform contrast roller 640 applies constant pressure to the adhesive areas of the blank 100 as hot-melt adhesive is applied. The glued blank 100 is then passed on to a folding station 660. The folding station 660 receives a wrapped assemblage of smoking articles 641 from a foil wrapping station 670. In the foil wrapping station, assemblages of smoking articles 671 are wrapped with wrapping materials 672. In the folding station 660, the wrapped assemblage of smoking articles 661 and inner frame insert 60 are placed on the blank 100, and the blank 100 is folded. Finally, a completed container 10 is formed.

While conventional paperboard containers generally use an adhesive requiring a heated curing or drying step, this heating step is preferably eliminated when using a hot-melt adhesive material. When the machine is first started, a first blank 100 running through the hot-melt adhesive applicator 542 is rejected to ensure that all completed packages 10 are properly glued. Also, when the cigarette packaging machine is shut down, the hot-melt adhesive applicator 542 is retracted into its non-operating position by the movable support 520.

The wrapped assemblage of smoking articles, which may include cigarettes, is preferably wrapped in a foil material. Suitable wrapping materials are foil-type materials (e.g., laminated metal foil/paper inner-liner materials). See, for example, US Pat. Pub. 2006/0168909 to Miyaoka et al., which is incorporated by reference herein. In one embodiment, the foil-type wrapper material may include a pattern visible through the transparent container. Such a pattern may be embossed or formed using other means known to those skilled in the art. In feeding the wrapping material into a packaging machine such as the G.D. X2, some feeding mechanisms or feeding wheels may impart a crease into the material. Because the packages formed by the present invention are generally at least partially transparent, it is desirable to modify such feeding mechanisms to avoid imparting creases to the wrapping material or otherwise marring the finish of the wrapping material.

The maximum height of each container can vary. The height of each container typically is dependent upon factors such as the lengths of the cigarettes that are contained therein. Generally, the height of each container is within the range of about 70 mm to 130 mm. For example, for a container designed to contain 20 cigarettes, each about 99 mm in length, a representative container can have a height of about 100 mm to about 103 mm. Alternatively, for example, for a container designed to contain 20 cigarettes, each about 84 mm in length, a representative container can have a height of about 85 mm to about 89 mm.

A representative assembled container has a maximum height of about 87 mm, a width of about 67 mm, a maximum depth of about 33 mm, and a minimum depth of about 23 mm. A typical cigarette is about 84 mm in length and about 24.5 mm in circumference. The containers are generally rectangular in cross-sectional shape, and generally rectangular box shape in overall appearance of dimensions to contain cigarettes in rows having either a ten-ten or seven-six-seven configuration. The dimensions of the container may vary depending on the desired number of cigarettes to be packaged in the container. Thus, such an assembled container has a height slightly greater than the smoking articles contained therein, and the width of the container is preferably greater than its depth. However, the container may be constructed to resemble any other non-rectangular shapes. Although the preferred container possesses vertically extending walls that extend in a almost truly vertical direction, those vertically extending walls can be adapted so as to extend generally vertically, and hence, provide a container that can be considered to be somewhat frusto-pyramidial in shape (e.g., the side walls can extend slightly outward from top to bottom, or the side wall can extend slightly inward from top to bottom), or form other geometric shapes.

Once the container is formed and filled with smoking articles, such as cigarettes, the container may be overwrapped. Exemplary overwrap materials include polypropylene, or such films characterized as "cellophane-type films" that conventionally have been employed for wrapping packaged cigarettes. Less preferably, overwrap materials such as the types set forth in U.S. Pat. No. 5,139,140 to Burrows et al., and U.S. Pat. No. 5,542,529 to Hein, III et al., may be used. Both U.S. Pat. No. 5,139,140 and U.S. Pat. No. 5,542,429 are incorporated herein by reference.

The outer wrapping material assembly can be equipped with tear tape. See, for example, U.S. Pat. No. 4,717,017 to Sprinkel, Jr. et al.; U.S. Pat. No. 4,836,378 to Lephardt; U.S. Pat. No. 5,192,262 to Amendola et al.; U.S. Pat. No. 5,595,803 to May et al.; and U.S. Pat. No. 7,118,792 to Hewitt et al.; each of which is incorporated herein by reference. Representative types of tear tape materials suitable for use in association with other cigarette packaging materials are available from sources such as Arlin Mfg. Co., Inc. of Lowell, Mass., and P. P. Payne Limited of Nottingham, United Kingdom.

The assembled container can be used in a variety of ways. In use, outer wrapping materials (e.g., clear, colorless polypropylene film) are removed from the assembled outer container, and those outer wrapping materials are discarded. The lid is moved to an open position to expose the relevant wrapping materials (e.g., an optional overwrap material, and the preferred piece of embossed paper/foil laminate that overlies the ends of the cigarettes) that cover the cigarettes contained in that packet.

The disclosed method, system, and materials provide an aesthetically pleasing appearance to a package of smoking articles, such as cigarettes. As described above, the modification of conventional packaging equipment in accordance with the teachings herein, such as precise placement of adhesive in coordinated patterns on transparent packaging materials, enables the creation of transparent packaging without visual impairment caused by the adhesive extending into visible areas. In comparison to conventional paperboard materials, the transparent packaging material requires greater precision to avoid visibly misapplied or squeezed-out adhesive patterns. Advantageously, the transparent packaging material allows decoratively embossed or patterned foil wrapper materials to visibly complement any patterns formed on the packaging material.

It is therefore intended that the foregoing detailed description be regarded as illustrative rather than limiting, and it should be understood that the following claims, including all equivalents, are intended to define the spirit and scope of this invention.

We claim:

1. A system for manufacturing a container for smoking articles, the system comprising:

a hopper configured to hold blanks;

a gear train;

a hot-melt adhesive applicator;

a feed belt operatively coupled to the gear train to move the blanks from the hopper to the hot-melt adhesive applicator;

an encoder coupled with the gear train and configured to track the translational movement of the blanks through the system;

an electronic blank sensor approximately opposite from the hot-melt adhesive applicator configured to signal when a blank enters the hot-melt adhesive applicator;

an electronic control unit in communication with the encoder, the electronic blank sensor, and the hot-melt adhesive applicator, the electronic control unit being configured to cause the hot-melt adhesive applicator to apply a pre-determined pattern of adhesive to the blank when the electronic control unit receives the signal from the electronic blank sensor; and a folding station configured to receive the blank from the hot melt adhesive applicator and to fold the blank into a container about an assemblage of smoking articles.

2. The system of claim 1 further comprising:

a movable support on which the hot-melt adhesive applicator is mounted, and a system processor configured to send a lift signal to raise the movable support to move the hot-melt adhesive applicator towards the electronic blank sensor when a first of the blanks is fed into the belt, and to send a retract signal to lower the hot-melt adhesive applicator away from the electronic blank sensor when the gear train is stopped.

3. The system of claim 2 further comprising a lever coupled to a pneumatic cylinder and the movable support, wherein the lift signal and retract signal cause the pneumatic cylinder to move the lever to a first position and a second position, respectively.

4. The system of claim 1 futher comprising the electronic control unit is configured to adjust a pressure and a rate of flow of hot-melt adhesive to the hot-melt adhesive applicator in response to a system parameter comprising a feed rate of blanks from the hopper.

* * * * *

UNITED STATES PATENT AND TRADEMARK OFFICE

CERTIFICATE OF CORRECTION

PATENT NO. : 7,866,122 B2
APPLICATION NO. : 12/813103
DATED : January 11, 2011
INVENTOR(S) : Jerry Wayne Pipes et al.

It is certified that error appears in the above-identified patent and that said Letters Patent is hereby corrected as shown below:

In column 12, claim 4, line 59, after "system of claim 1" replace "futher" with --further--.

Signed and Sealed this
Tenth Day of May, 2011

David J. Kappos

David J. Kappos
*Director of the United States Patent and Trademark Office*